US006919902B2

(12) United States Patent
Jeffrey et al.

(10) Patent No.: US 6,919,902 B2
(45) Date of Patent: Jul. 19, 2005

(54) METHOD AND APPARATUS FOR FETCHING PIXEL DATA FROM MEMORY

(75) Inventors: Eric Jeffrey, Richmond (CA); Barinder Rai, Surrey (CA)

(73) Assignee: Seiko Epson Corporation, Tokyo (JP)

( * ) Notice: Subject to any disclaimer, the term of this patent is extended or adjusted under 35 U.S.C. 154(b) by 220 days.

(21) Appl. No.: 10/161,965

(22) Filed: Jun. 3, 2002

(65) Prior Publication Data

US 2003/0222882 A1 Dec. 4, 2003

(51) Int. Cl.[7] ..... G09G 5/36

(52) U.S. Cl. ..... 345/560; 345/533; 345/530; 345/531

(58) Field of Search ..... 345/530, 531, 345/560, 533, 475, 606; 348/793, 305, 320, 550

(56) References Cited

U.S. PATENT DOCUMENTS 5,173,774 A 12/1992 Bretl et al.
5,537,563 A * 7/1996 Guttag et al. ..... 711/100
5,561,777 A 10/1996 Kao et al.
5,585,824 A 12/1996 Sherburne
5,818,433 A 10/1998 Sherburne
5,963,192 A 10/1999 Wong et al.
6,041,361 A * 3/2000 Wilson et al. ..... 709/253
6,067,120 A 5/2000 Horikawa et al.
6,081,303 A 6/2000 Kim
6,094,226 A 7/2000 Ke et al.
6,272,497 B1 8/2001 Mendenhall et al.
6,441,858 B1 * 8/2002 Nakamoto et al. ..... 348/446
2001/0015768 A1 8/2001 Shin et al.

FOREIGN PATENT DOCUMENTS

JP 4-296173 10/1992

* cited by examiner

*Primary Examiner*—Kee M. Tung
*Assistant Examiner*—Hau Nguyen

(57) ABSTRACT

A graphics controller for preparing data to be presented on a display through an interlaced scan is provided. The graphics controller includes a memory and a line buffer adapted to receive video data. Data arrangement circuitry in communication with the line buffer is included. The data arrangement circuitry is configured to process the received video data in order to store the received data in the memory as an even segment and a corresponding odd segment, the even segment associated with data from a line of an even field, the odd segment associated with data from a line of an odd field, the even segment and the corresponding odd segment defining a pixel of data. A single pipe buffer configured to retrieve the even segment and the corresponding odd segment in a single memory access to the memory is included. A system using the graphics controller and a method of storing and retrieving pixel data from memory are also provided.

27 Claims, 14 Drawing Sheets

METHOD AND APPARATUS FOR FETCHING PIXEL DATA FROM MEMORY

BACKGROUND OF THE INVENTION

1. Field of the Invention

This invention relates generally to image display systems and more particularly to a method and apparatus for storing and fetching image data to be presented on a display screen through interlaced scanning.

2. Description of the Related Art

Televisions are the centerpiece of household entertainment. The functionality provided by televisions is constantly being expanded. More recently, with the blurring of the boundaries between computers and televisions, televisions are acquiring more qualities of computers and vice-versa. Additionally, televisions are moving from analog processing to digital processing. With the convergence between the devices, greater demands are placed on the systems. Thus, more data is being processed by the systems and the demands on the system memory are increasing, thereby requiring a higher bandwidth to avoid image corruption. Additionally, the quality and the resolution of the displays on the television systems are constantly improving, thereby placing further processing demands on the system.

Images presented on the display screen of a television employ interlaced scanning to ensure that the picture has an even brightness throughout instead of having separate bright and dark bands. That is, each still picture is made up of two scans consisting of alternate lines. For example, the even numbered lines are scanned and then the odd numbered lines are scanned, with a complete pass through all the even and odd numbered lines defining one frame of data.

Sharp transitions in color between adjacent scan lines result in flicker when presented on a television screen. That is, flicker is caused on a National Television System Committee (NTSC) monitor screen when a pixel or horizontal group of pixels of a higher intensity are bordered on both the top and bottom by lower intensity pixels. The flicker causes a strain on human eyes as well as deterring from the quality of the display. Since bandwidth is a concern with television, interlaced scanning has been adopted to allow the frame repetition rate to be reduced by one half, as interlaced scanning scans half the lines in each vertical scan. Thus, each frame takes two vertical scans with even and odd lines scanned on alternate fields.

FIG. 1 is a simplified schematic diagram of a system for storing image data in a television's memory. Image data is stored in memory 100 as alternating even and odd lines due to the ease of use for the software that interacts with the data. A separate memory access is necessary for odd line data and even line data. That is, one memory access is performed to fetch even line data to be placed in even buffer 102, and a separate memory access is made to fetch odd line data to be placed in odd buffer 104. The even and odd line data are then averaged through flicker filter 106 and eventually output as a single line to display 104. Thus, in order to output a single pixel of display data, two memory accesses must be made to acquire the even and odd line data to be averaged from each of the two buffers.

The multiple fetches from the buffers place high demands on the memory when other devices are competing for memory. In turn, a high bandwidth is required from memory in order to keep up with the requests for data. If the memory can't support the requests for data, then image corruption on the display results in an incomprehensible display, i.e., corrupted image. Furthermore, as television systems further enhance the functionality available to the viewer and as television manufacturers simultaneously embrace high definition technology, the demands on memory will further rise. In turn, costs are incurred in supporting these demands in terms of the increased memory capacity to avoid image corruption and increased power consumption.

As a result, there is a need to solve the problems of the prior art to provide an apparatus and method for reducing the demands on the memory for a system used to generate a display through interlaced scanning, while maintaining the image quality.

SUMMARY OF THE INVENTION

Broadly speaking, the present invention fills these needs by providing a method and a graphics controller configured to execute the method for storing and fetching data from memory. It should be appreciated that the present invention can be implemented in numerous ways, including as a process, a system, or a device. Several inventive embodiments of the present invention are described below.

In one embodiment, a graphics controller for preparing data to be presented on a display through an interlaced scan is provided. The graphics controller includes a memory and a line buffer adapted to receive video data. Data arrangement circuitry in communication with the line buffer is included. The data arrangement circuitry is configured to process the received video data in order to store the received data in the memory as an even segment and a corresponding odd segment. The even segment is associated with data from a line of an even field, while the odd segment is associated with data from a line of an odd field. The even segment and the corresponding odd segment define a pixel of data. A single pipe buffer configured to retrieve the even segment and the corresponding odd segment in a single memory access to the memory is included.

In another embodiment, an apparatus for enabling display of an interlaced image on a display screen is provided. The apparatus includes a central processing unit (CPU) and a bus. A graphics controller configured to receive image data is also included. The graphics controller is in communication with the CPU through the bus. The graphics controller includes a memory and data arrangement circuitry for processing image data so that the image data can be stored in the memory as an even segment and a corresponding odd segment, where the even segment and the corresponding odd segment define a pixel of data. A single pipe buffer configured to retrieve the even segment and the corresponding odd segment in a single memory access to the memory is included.

In yet another embodiment, a method for presenting image data to a display screen configured to support interlaced scanning is provided. The method initiates with storing image data in memory as alternating even segments and odd segments. Each pair of the alternating even segments and odd segments defines at least one pixel. Then, both the even segment of data and the odd segment of data are retrieved with a single memory access. Next, the pixel defined by the even segment and the odd segment is sent for presentation on a display screen configured to support interlaced scanning.

In still yet another embodiment, a method for storing interlaced image data from an even field and an odd field of a frame is provided. The method initiates with receiving image data from a video source. Then, the image data is stored in memory as pairs of even and odd segments. The even segments correspond to an even line, while the odd segments correspond to an odd line. The even line and the odd line are adjacent to each other and the associated even and odd segments define at least one pixel.

Other aspects and advantages of the invention will become apparent from the following detailed description, taken in conjunction with the accompanying drawings, illustrating by way of example the principles of the invention.

BRIEF DESCRIPTION OF THE DRAWINGS

The present invention will be readily understood by the following detailed description in conjunction with the accompanying drawings, and like reference numerals designate like structural elements.

DETAILED DESCRIPTION OF THE PREFERRED EMBODIMENTS

Figure 1:
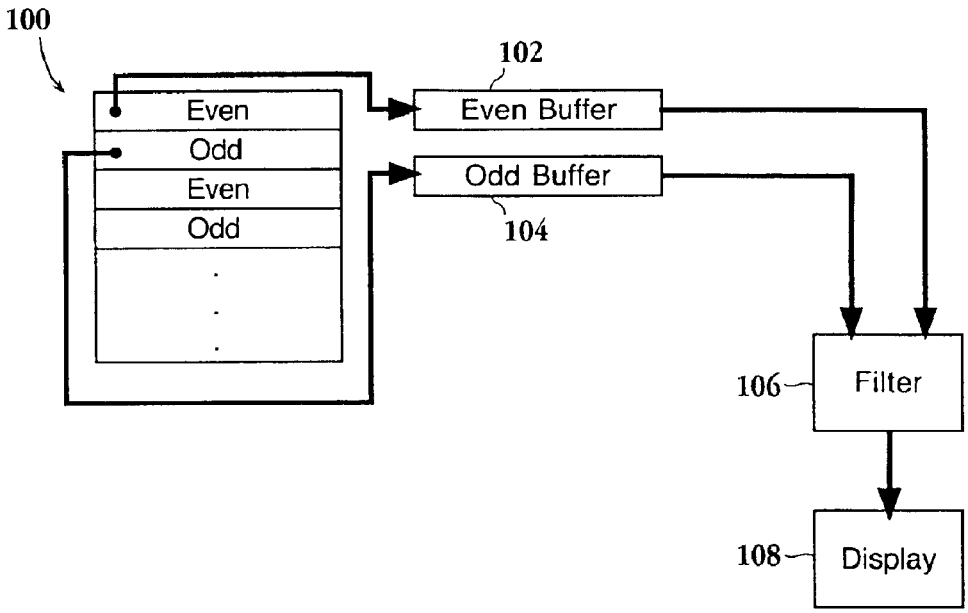
Fig. 1 (prior art)
FIG. 1 is a simplified schematic diagram of a system for storing image data in a television's (TV) memory.

An invention is described for an apparatus and method for efficiently storing image data to allow for expedited fetching of the image data without increasing the demands on the memory, wherein the image data is to be presented through interlaced scanning. It will be apparent, however, to one skilled in the art, from the following description, that the present invention may be practiced without some or all of these specific details. In other instances, well known process operations have not been described in detail in order not to unnecessarily obscure the present invention. FIG. 1 is described in the "Background of the Invention" section.

The embodiments of the present invention provide an apparatus and a method for storing and fetching pixel data from memory for a system configured to display an image through interlaced scanning. Incoming video data is stored in memory as alternating segments of even and odd lines of a frame of data for an interlaced scan. In one embodiment, a 16 bit segment from an even line and a corresponding 16 bit segment from an odd line are paired and stored in memory. The even and the odd lines are adjacent lines of a frame of data. By storing the incoming video data as alternating even and odd segments a single memory access by a display pipe can fetch one pixel of data. That is, a single memory access over a 32 bit bus results in obtaining the 16 bit even segment and the 16 bit odd segment in one embodiment of the invention. As a result, the demands on memory from the display pipe are significantly reduced.

Figure 2:
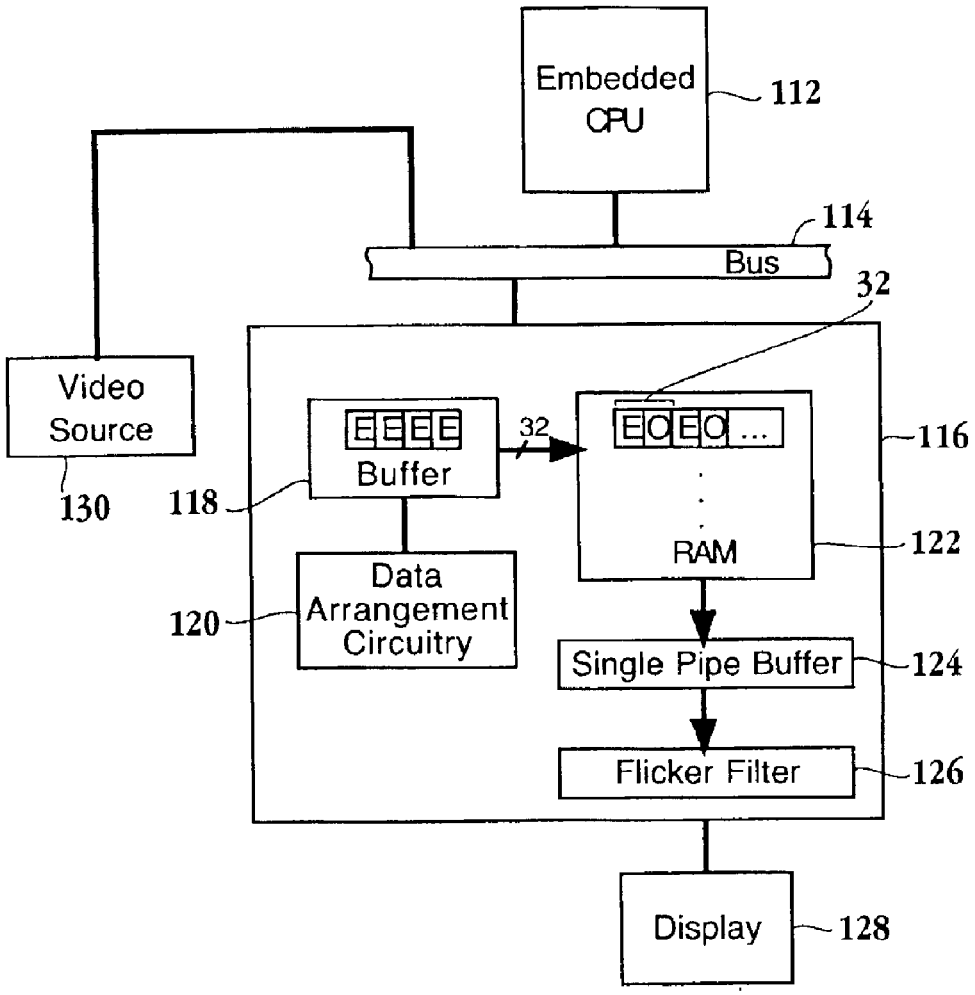
FIG. 2 is a schematic diagram of a graphics controller configured to prepare data to be presented on a display through an interlaced scan in accordance with one embodiment of the invention.

FIG. 2 is a schematic diagram of a graphics controller configured to prepare data to be presented on a display through an interlaced scan in accordance with one embodiment of the invention. Central processing unit (CPU) 112 is in communication with graphics controller 116 through bus 114. Video source 130 supplies video image data to be processed by graphics controller 116 and presented on display 128. In one embodiment, video image data is supplied from an external source to graphics controller 116 as directed by CPU 112. In another embodiment, video image data is supplied directly to graphics controller 116 from a live feed, such as a cable television or satellite source. Graphics controller 116 includes one line buffer 118 in communication with random access memory (RAM) 122 through a 32-bit bus. It should be appreciated that the bus connecting RAM 122 to buffer 118 is not limited to a 32-bit bus size but can be any suitable size bus. Data arrangement circuitry 120 is in communication with buffer 118. Data arrangement circuitry is configured to process the video data to enable storage of the data in RAM 122 as alternating even and odd segments, as will be explained in more detail below. In one embodiment, the even and odd segments are each 16-bit segments, thereby resulting in a combined segment size of 32 bits. The even segment corresponds to an even line, while the odd segment corresponds to an odd line of an interlaced image. It should be appreciated that each even and odd segment pair corresponds to an adjacent even and odd line, respectively. Thus, each even and odd segment pair define a pixel of data. By storing the video image data as alternating chunks of 16-bit even and odd data, single pipe buffer 124 is allowed to fetch a pixel of data in one memory access. That is, in one 32-bit fetch, both even and odd pixel data is obtained. The even and odd pixel data fetched by single pipe buffer 124 is transferred to flicker filter 126. As is well known, flicker filter 126 is configured to reduce a flicker on a display of an interlaced scan by averaging data from adjacent lines to smooth a contrast between displayed lines. In turn, the flicker filter data is output to display 128 for presentation on a display screen configured to present an image through interlaced scanning, such as a television (TV) display screen.

Still referring to FIG. 2, one skilled in the art will appreciate that CPU 112 can be a digital signal processor (DSP) containing code for directing video data from video source 130 to graphics controller 116 over bus 114. Additionally, CPU 112 can be a component of an embedded system. In one embodiment, buffer 118 is sized to hold one line of even or odd data. Buffer 118 includes suitable storage circuitry such as latches, flip flops, etc., to store incoming video image data and eventually transfer the data to RAM 122. Data arrangement circuitry 120 includes circuitry, i.e., logic gates, counters comparators, registers, etc., for shifting the incoming video data to buffer 118, and enabling the transfer of the appropriate even and odd segments to RAM 122. In one embodiment, buffer 118 is a shift register consisting of a number of clocked latches or flip flops suitable to store one line of incoming video data from video source 130. It should be appreciated that incoming video data from video source 130 will come in an interlaced form. That is, the incoming video data will be transmitted in adjacent even and odd lines.

Figure 3:
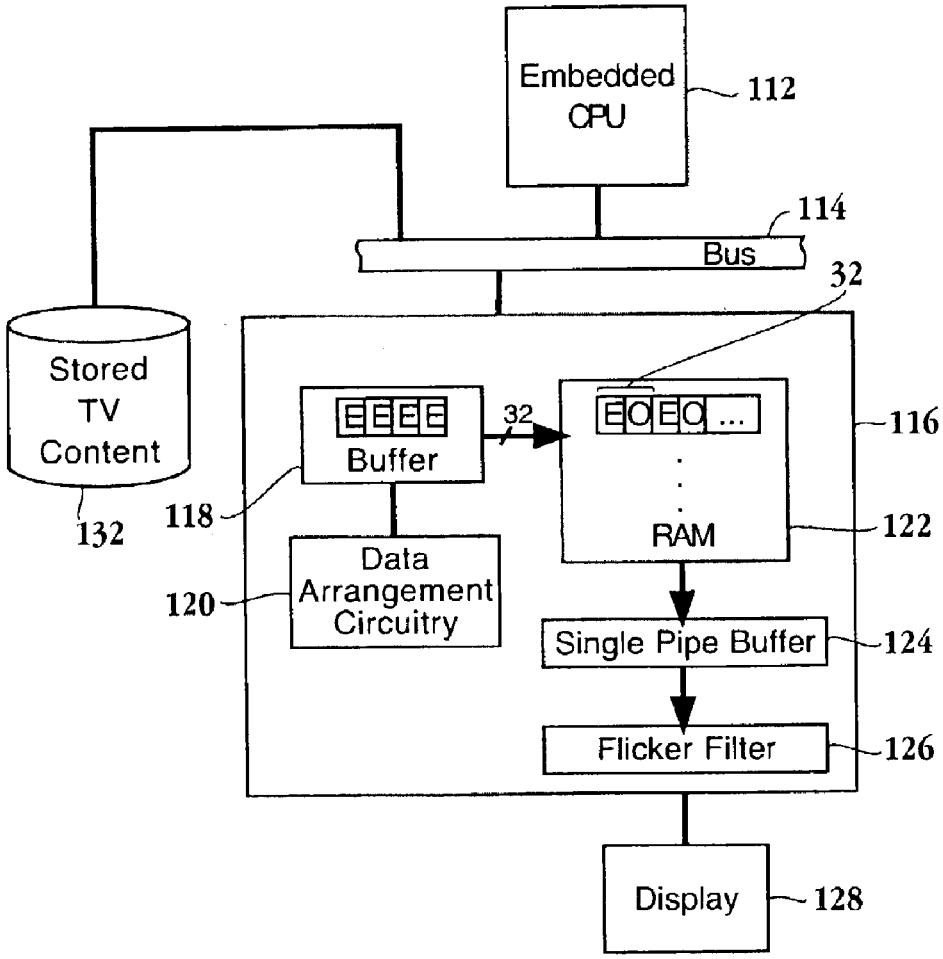
FIG. 3 is a schematic diagram of a graphics controller of FIG. 2 where the video image data is supplied by stored television (TV) content.

FIG. 3 is a schematic diagram of a graphics controller of FIG. 2 where the video image data is supplied by stored television (TV) content. Stored TV content 132 can be any suitable TV content associated with digital television or high definition television. For example, stored TV content could be data stored on a hard drive such as those associated with digital video recorders. Similar to FIG. 3, CPU 112 directs stored TV content 132 to graphics controller 116. Graphics controller 116 processes the stored TV data as described with respect to FIG. 2. That is, the TV data is stored in RAM 122 as alternating pairs of even and odd segments so that single pipe buffer 124 can acquire one pixel of data in a single fetch. It should be appreciated that as only one memory access to RAM 122 is required to output a 32 bit pixel of data, the demands of single pipe buffer 124 on RAM 122 is reduced by about 50% since previously two fetches were required to output a 32 bit pixel of data.

Figure 4A:
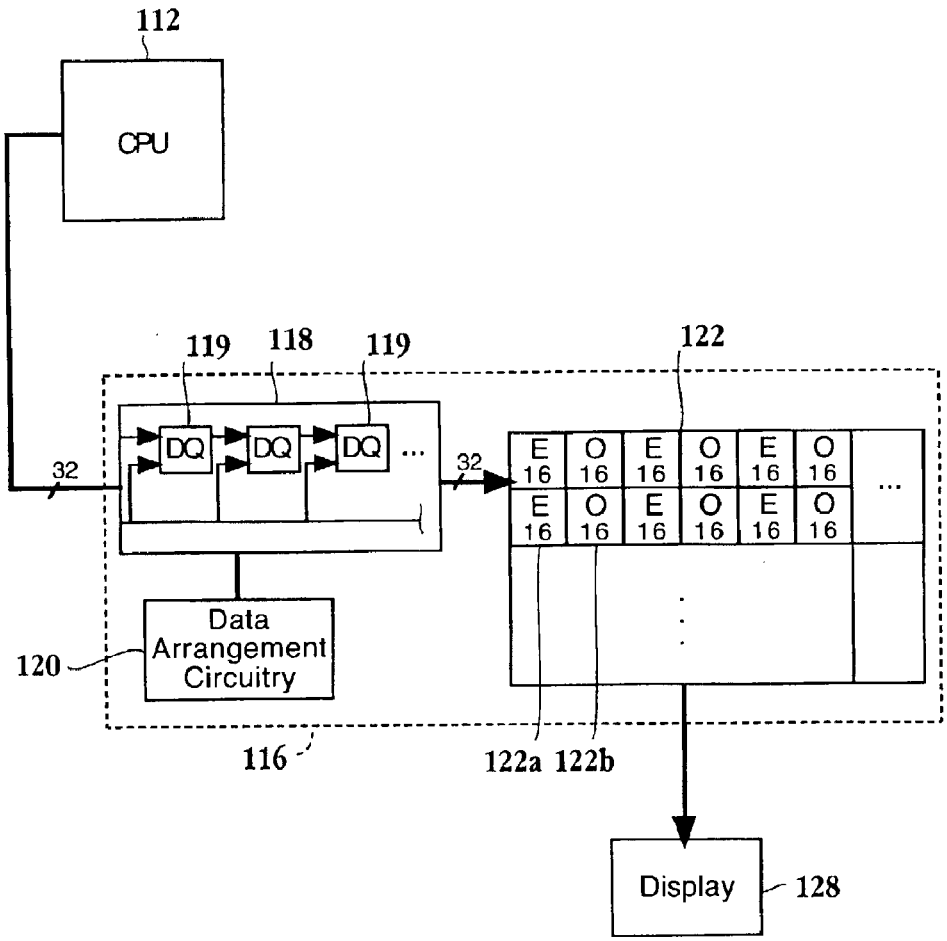
FIG. 4A is a schematic diagram of received video image data stored as alternating even and odd segments in memory of a graphics controller in accordance with one embodiment of the invention.

FIG. 4A is a schematic diagram of the received video image data being stored as alternating even and odd segments in memory of a graphics controller in accordance with one embodiment of the invention. CPU 112 directs video image data to graphics controller 116 over a 32-bit bus. The interlaced video image data is input into line buffer 118. As shown here, line buffer 118 is a shift register including a row of storage circuits, such as flip flops 119, allowing digital data to be shifted successively to the right. In one embodiment, the number of flip flops 119 of line buffer 118 is suitable to hold one line of data for display 128. It should be appreciated that line buffer 118 can be of varying suitable sizes. For example, if display 128 is a television screen having 480 pixels in each horizontal line of the display, then line buffer 118 will include enough flip flops 119 to hold 480 pixels (one line) worth of data. As mentioned above, data arrangement circuitry 120 includes the hard coded instructions for storing the incoming video data into buffer 118 in alternating even and odd segments in RAM 122. Data arrangement circuitry 120 is discussed in more detail with reference to FIG. 4B. In one embodiment, once a complete line of incoming video data has entered line buffer 118, the first even segment from line buffer 118 is shifted to RAM 122 along with the first odd segment, where the even and odd segments correspond to adjacent lines of the interlaced data. This process is repeated for each line of the incoming video data.

Still referring to FIG. 4A, RAM 122 is shown storing the data as alternating even and odd segments of 16-bit data. In one embodiment, each alternating 16-bit even and 16 bit odd data pair defines a pixel. That is, even 16-bit data 122A and corresponding odd 16-bit data 122B define a pixel. One skilled in the art will appreciate that while the data stored in RAM 122 is shown as even data followed by odd data, the order of the data in RAM 122 is not significant as long as the pattern defining each pixel is known. It should be appreciated that while FIG. 4A represents the even data from an even line and the corresponding odd data from an adjacent odd line, the data may be stored in alternate patterns that define a pixel of data. For example, where the average of segments from three adjacent lines are used, rather than segments from two lines, the alternating even and odd segments would be 10-bit size segments. That is, triplets made up of alternating even and odd segments are stored in RAM 122. Here, a single 32 bit fetch would result in acquiring a pixel of data with 2 of the 32 bits not being valid data. It will be apparent to one skilled in the art that the pattern for storing alternating segments of even and odd data dictates a minimum size for buffer 118. For exemplary purposes, FIG. 4A displays the alternating even and odd segments in a logical layout. It will be apparent to one skilled in the art that physical layout of the data in RAM 122 can differ than the logical layout.

Figure 4B:
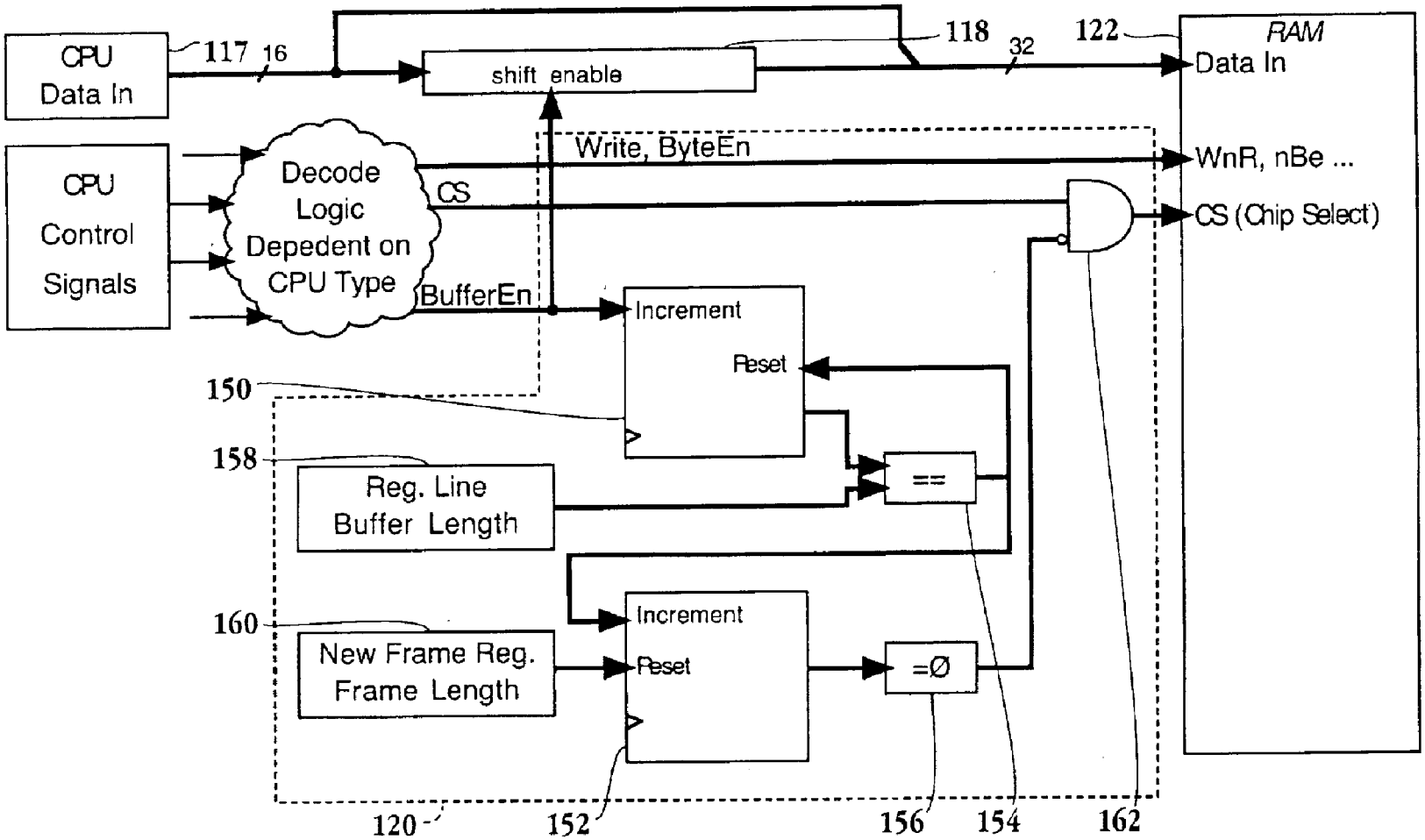
FIG. 4B is a schematic diagram of the components of the data arrangement circuitry of a graphics controller configured to store alternating even and odd segments in memory in accordance with one embodiment of the invention.

FIG. 4B is a schematic diagram of the components of the data arrangement circuitry of a graphics controller configured to store alternating even and odd segments in memory in accordance with one embodiment of the invention. CPU data 117 is received by line buffer 118. Data arrangement circuitry 120 processes CPU data 117 so that the CPU data can be stored as segments of even and odd data in memory. As CPU data 117 is received by the graphics controller, the data is placed into line buffer 118. In one embodiment line buffer 118 is a shift register and a shift enable signal communicated to the shift register directs the shift register to shift the data as more data comes in. In one embodiment, the shift enable signal is sent to each latch or flip flop of line buffer 118. Thus, if the shift enable signal is active high, all the latches or flip flops are shifted when the shift enable is high during the clock cycle. However, if the shift enable signal is low, then nothing happens during the clock cycle.

CPU control signals are translated by decode logic. Of course, the decode logic is dependent on a type of CPU. It should be appreciated that the decode logic provides the address in memory, such as RAM 122, for data to be written to or read from the RAM. For example, a word line and bit line address can be provided through the decode logic. In one embodiment, the control signals include a write signal, a byte enable signal, a chip select (CS) signal and a buffer enable signal. It will be apparent to one skilled in the art, that in one embodiment, the decode logic is located on the graphics controller at an interface of RAM 122.

Line buffer counter 150 of FIG. 4B counts the data received by line buffer 118. That is, each time new data is shifted into line buffer 118, line buffer counter 150 is incremented. As mentioned above, for interlaced scanning a frame of data is composed of a number of even and odd lines. The length of a line is stored in a register, such as RegLineBufferLength 158. Line buffer counter 150 outputs data to comparator 154. Comparator 154 compares the data from line buffer counter 150 to the length of the line from RegLineBufferLength 158 to determine if line buffer 118 has been filled with a line. Once line buffer 118 has been filled with a line of data, comparator 154 outputs a reset signal to line buffer counter 150, in order for the line buffer counter to begin counting the data for the next line as the data is received by the line buffer.

Still referring to FIG. 4B, a signal from comparator 154 is sent to line counter 152 in addition to line buffer counter 150. Line counter 152 counts the number of lines for the frame and prevents writes to memory 122 while line buffer 118 is being filled with the first line of a frame. Comparator 156 compares the output from line counter 152 to determine if the line counter is zero, i.e., the first line is being received by line buffer 118. Thus, when line counter 152 is zero, writes to memory are not permitted as line buffer 118 is being filled the first line of the frame. In one embodiment, AND gate 162 outputs a chip select (CS) signal low to prevent writing to memory. Once line counter 152 is incremented, i.e., line buffer 118 has been filled with one line of data, memory writes are allowed. That is, the output from comparator 156 is driven high once line counter 152 is incremented from 0, in turn, the output from AND gate 162 is high as both inputs to AND gate 162 are high. Then, for each CPU write, data from the CPU and data from line buffer 118 are written to memory. Of course, the write scheme of the data from the CPU and the data from line buffer 118, such as alternating even and odd segments, is dependent on the method for flicker filtering the data. Exemplary methods for flicker filtering the data are discussed with reference to FIGS. 8A–8C. It will be apparent to one skilled in the art that while the signals described above are active high, the circuitry can also be designed such that the signals are active low. It should be appreciated that an odd segment and an even segment of data are written to memory 122 and stored as alternating pairs in one embodiment to accommodate the flicker filtering schemes of FIGS. 8A and 8B.

Figure 5:
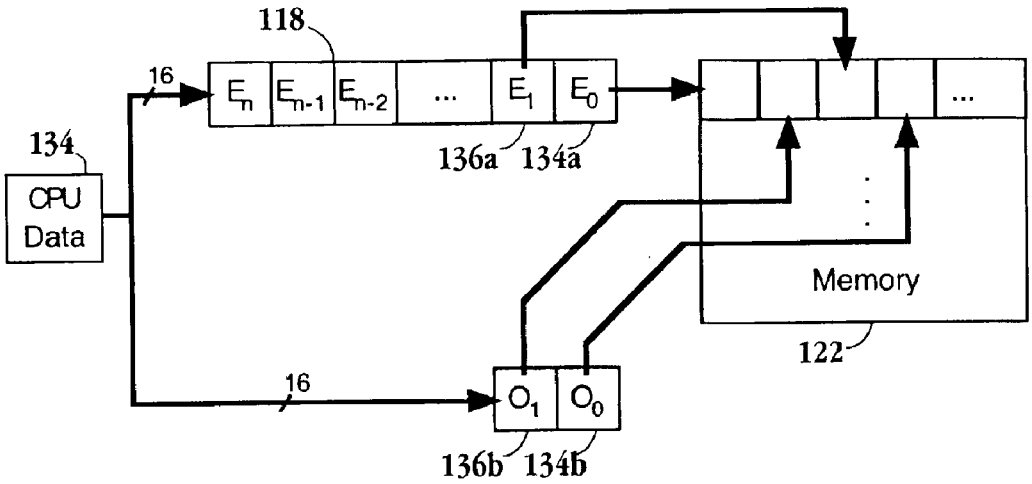
FIG. 5 is a schematic diagram of the process of writing data in alternating even and odd segments in memory in accordance with one embodiment of the invention.

FIG. 5 is a schematic diagram of the process of writing data in alternating even and odd segments in memory in accordance with one embodiment of the invention. CPU data 134 is written into line buffer 118. As mentioned above, line buffer 118 acts as a shift register. That is, as each even segment of the first line of data, represented by $E_0$ through $E_n$, is received by line buffer 118, each segment in the line buffer is shifted to the right one position. In one embodiment, line buffer 118 is sized to hold segments corresponding to one interlaced-scan line of image data. In one embodiment, the location occupied by $E_0$ 134*a* is enabled to be written to memory 122. The corresponding odd segment of data $O_0$ 134*b* is paired with $E_0$ 134*a* in memory 122. One skilled in the art will appreciate that as $E_0$ 134*a* is shifted out of line buffer 118, $E_1$ 136*a* shifts right one position. Then, $E_1$ 136*a* is written into memory 122. Similarly, odd segment $O_1$ 136*b* corresponding to even segment $E_1$ 136*a* is written into memory 122. This process is continued until each pixel represented by the even and odd lines of an interlaced image is placed into memory 122 as alternating segments of even and odd data. It should be appreciated that the data arrangement circuitry allows for the placement of the even and odd segments in memory as alternating pairs, wherein each pair represents data from adjacent lines of an interlaced scan. As will be explained in more detail with respect to FIG. 6B, data from more than two adjacent lines can be placed in memory as alternating segments such that each segment combination represents one pixel of data to be displayed on an image screen.

Figure 6A:
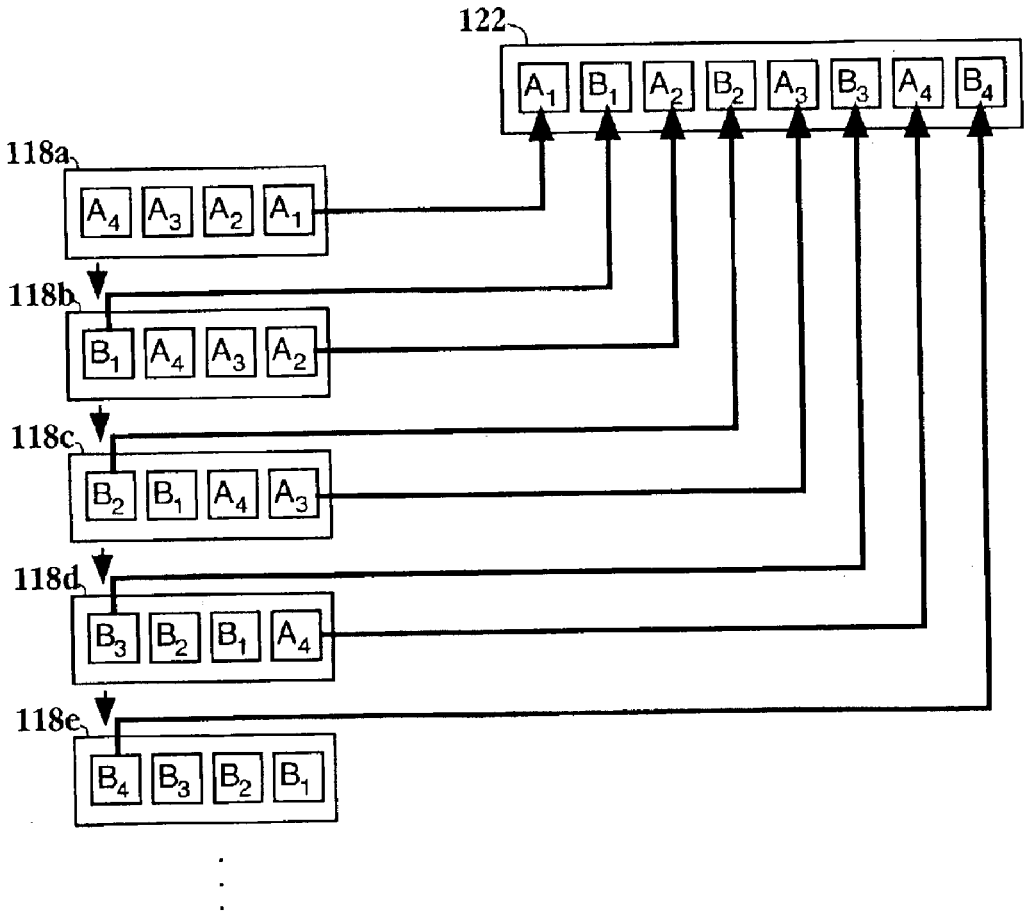
FIG. 6A is a pictorial representation of the process for writing data into memory as alternating segments of even and odd data in accordance with one embodiment of the invention.

FIG. 6A is a pictorial representation of the process for writing data into memory as alternating segments of even and odd data in accordance with one embodiment of the invention. For exemplary purposes, $A_1$ through $A_4$ represent segments of an even line while $B_1$ through $B_4$ represent segments of an odd line. Thus, each segment of an even line is placed into buffer 118*a* from a video source, such as broadcast data or stored television content. Segment $A_1$ is written to memory 122, and the remaining segments ($A_2$–$A_4$) are shifted to the right as odd segment $B_1$ is placed into line buffer 118*b*, and odd segment $B_1$ is also written into memory. It should be appreciated that segment $A_1$ and segment $B_1$ are written to memory 122 in a single 32 bit write, i.e., a single memory access. Additionally, odd segment $B_1$ is paired with corresponding even segment $A_1$, such that segments $A_1$ and $B_1$ are from adjacent lines of an interlaced scan. Next, even segment $A_2$ is written into memory 122 and the remaining segments ($A_3$, $A_4$, $B_1$) are shifted to the right as odd segment $B_2$ is placed into line buffer 118*c*, and is also written into memory. This process continues as described above as each of segments $A_1$ through $A_4$ of the even line is associated with a corresponding segment, $B_1$ through $B_4$ of an odd line in memory 122. The process is repeated for the even and odd lines composing a frame of an interlaced scan. It should be appreciated that line buffers 118*a*, 118*b*, and 118*c* represent line buffer 118 of FIG. 5 at different time periods as different segments are stored in line buffer 118.

Figure 6B:
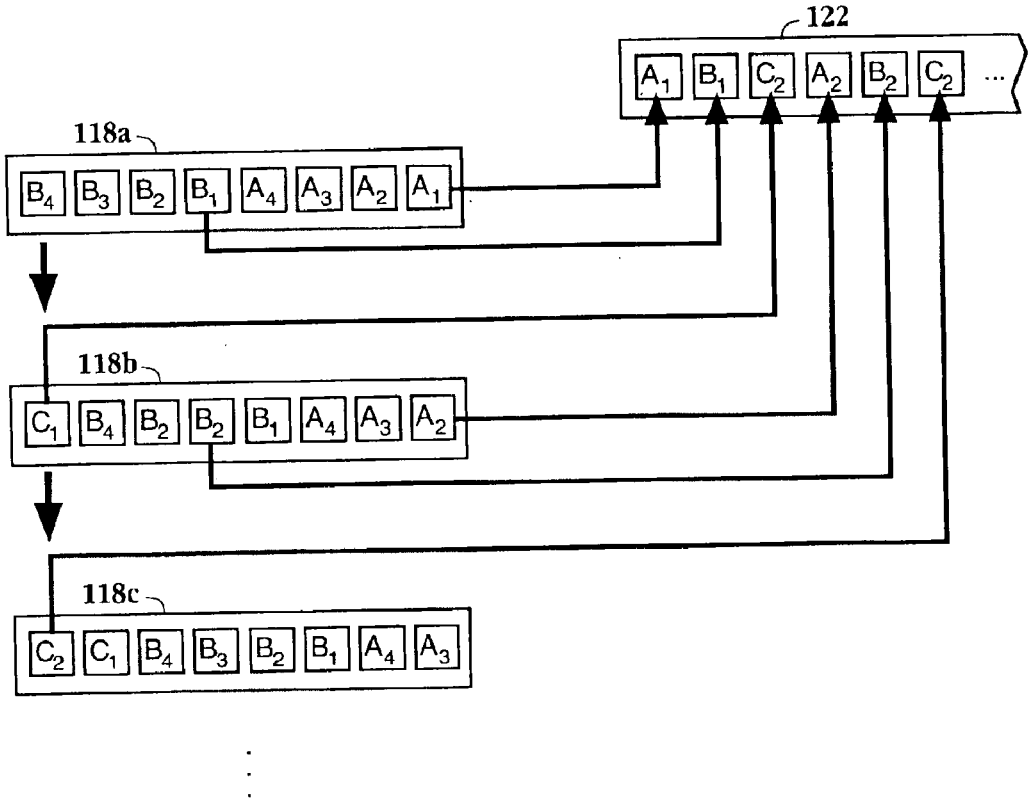
FIG. 6B is a pictorial representation where segments from three consecutive lines are stored in memory in accordance with one embodiment of the invention.

FIG. 6B is a pictorial illustration where segments from three consecutive lines are used to define a pixel in accordance with one embodiment of the invention. Here, segments $A_1$ through $A_4$ and $B_1$ through $B_4$ are received into line buffer 118*a*. Segment $A_1$ is paired with segments $B_1$ and $C_1$ in memory 122, wherein the triplet defined by segments $A_1$, $B_1$, and $C_1$ defines a pixel of data. More particularly, the segments in line buffer 118*a* are shifted as segment $C_1$ is received, as represented by the configuration of line buffer 118*b*. Then, segments $A_2$ and $B_2$ are copied into memory 122. Segment $C_2$ is also included with $A_2$ and $B_2$ as segment $C_2$ is received, as represented by the configuration of line buffer 118*c*. It should be appreciated that segment $A_1$, segment $B_1$ and segment $C_1$ are written to memory 122 in a single 32 bit write, i.e., a single memory access. The process of creating alternating triplets of corresponding data segments from three consecutive scan lines is repeated for the frame of lines for the interlaced scan. In one embodiment, each segment, $A_1$, $B_1$, and $C_1$, is 10 bits in size for a total bit size of 30 bits. Thus, for a 32 bit fetch from memory 122, two of the bits would not provide valid data, therefore, the two bits of invalid data are disregarded. As mentioned above, it should be appreciated that line buffers 118*a*, 118*b*, and 118*c* represent line buffer 118 of FIG. 5 at different time periods, as different segments are stored in line buffer 118. That is, line buffers 118*a*, 118*b*, and 118*c* are snapshots of different configurations of line buffer 118 as data is being received. Furthermore, the embodiment described with respect to FIGS. 6A and 6B can be adapted to process segments from more than two or three consecutive lines. One skilled in the art will appreciate that the size of line buffer 118 varies according to the pattern in which the segments are stored in memory, i.e., pairs, triplets, etc.

Figure 7A:
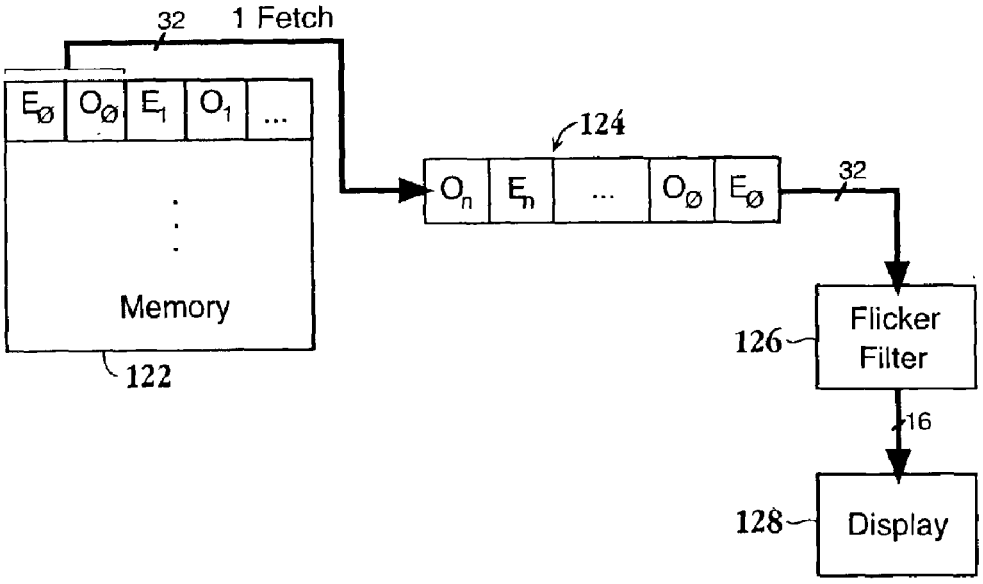
FIG. 7A is a schematic diagram of a single memory access being performed to obtain a pixel of data in accordance with one embodiment of the invention.

FIG. 7A is a schematic diagram of a single memory access being performed to obtain a pixel of data in accordance with one embodiment of the invention. Here, even segment and corresponding odd segment-are stored in memory 122 as described above with reference to FIGS. 4, 5 and 6A, thereby allowing display pipe 124 to fetch one pixel of data a single memory access. That is, over the 32-bit bus between display pipe 124 and memory 122, one memory access will result in fetching one pixel of data. It should be appreciated that by storing the alternating even and odd segments of data in memory enables one memory access for fetching a pixel of data, as opposed to multiple memory accesses. Display pipe 124 is in communication with flicker filter 126. One skilled in the art will appreciate that flicker filter 126 averages the corresponding even and odd segments in order to minimize a flicker associated with an interlaced scan images. The filtered pixel data is then displayed on display screen 128. In one embodiment display screen 128 is configured to display an interlaced scan, such as a television screen.

Figure 7B:
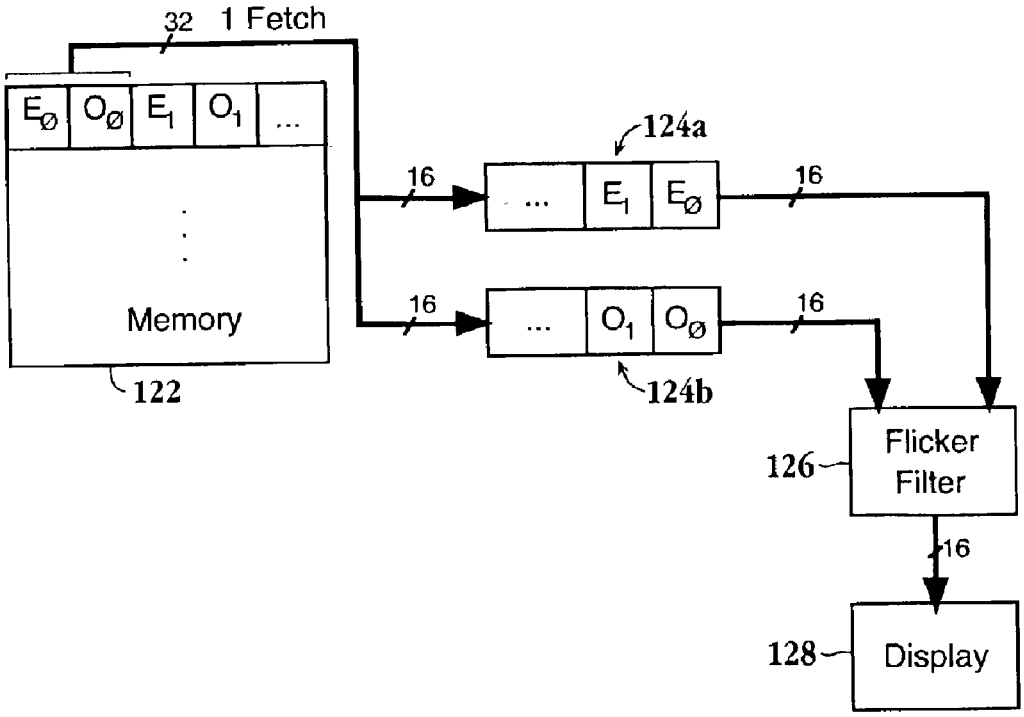
FIG. 7B is a schematic diagram where two display pipes feed a flicker filter as an alternative to the embodiment of FIG. 7A.

FIG. 7B is a schematic diagram in which two display pipes feed the flicker filter as opposed to the single display pipe of FIG. 7A. Here, a single memory access is still used to fetch one pixel of data. However, even segments from the single memory access are directed to display pipe 124*a* while odd segments are directed to display pipe 124*b*. The corresponding even and odd segments are input to flicker filter 126 over a 16-bit bus. Flicker filter 126 averages the data as discussed with reference to FIG. 7A. The averaged data is then displayed on display screen 128. It should be appreciated that the demands on memory 122 from display pipe 124 are reduced as one fetch results in acquiring one pixel of data.

Figure 8A:
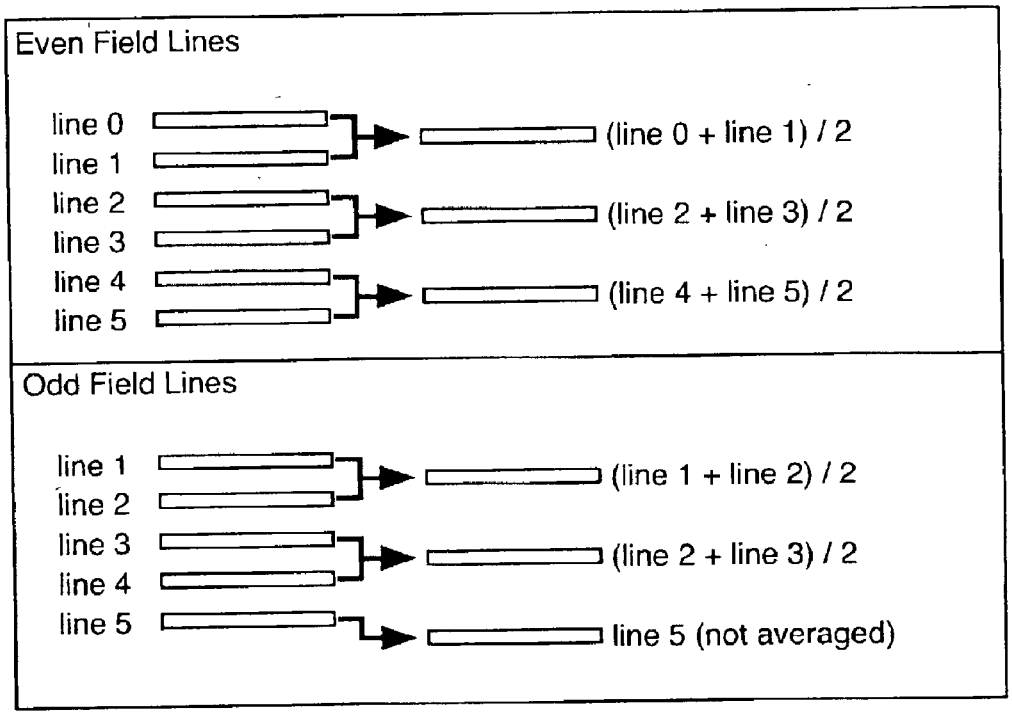
FIG. 8A is a schematic diagram of a flicker filtering technique for image data to be presented through an interlaced scan in accordance with one embodiment of the invention.

FIG. 8A is a schematic diagram of a flicker filtering technique for image data to be presented through an interlaced scan in accordance with one embodiment of the invention. One skilled in the art will appreciate that flicker filtering reduces a flicker caused by contrast between adjacent lines of an interlaced scan. Even field lines (field 0) begin with line 0 and average each pair of lines. For example, line 0 and line 1 are averaged to produce a first line of the even field, then lines 2 and 3 are averaged to produce a second line of the even field, and so on. Odd field lines (field 1) begin with line 1 and average each pair of lines. For example, line 1 and line 2 are averaged to produce a first line of the even field, then lines 3 and 4 are averaged to produce a second line of the even field, and so on. Accordingly, the first display line in field 0 contains information from original line 0, but the first display line in field 1 does not contain any information from original line 0. In one embodiment of the invention the data and arrangement circuitry of FIG. 4B is configured to accommodate the flicker filtering technique described above.

Figure 8B:
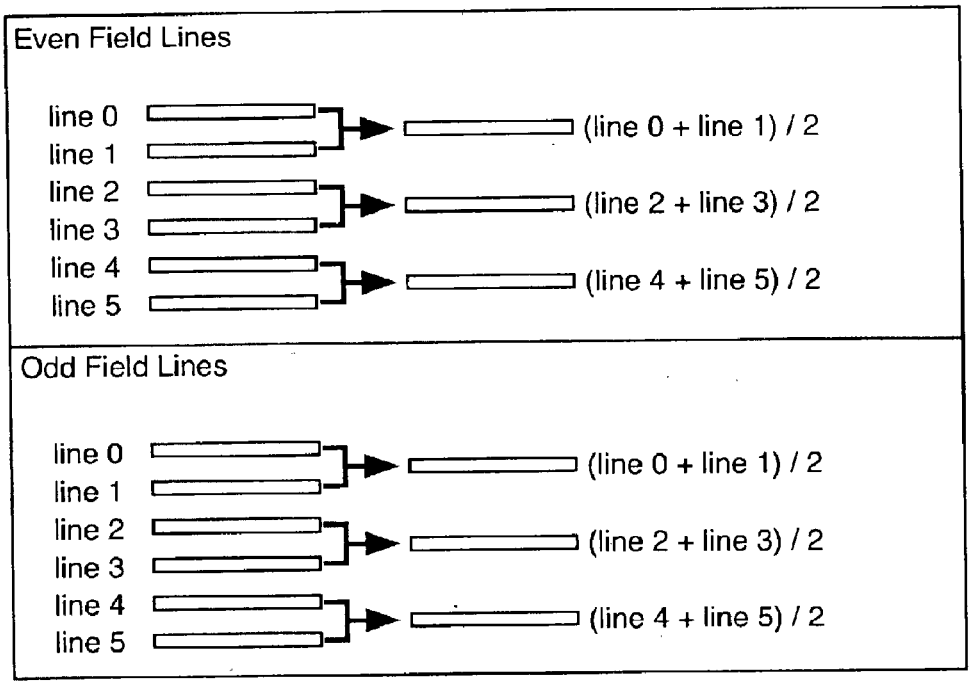
FIG. 8B is a schematic diagram of an alternative flicker filtering algorithm for an image displayed through interlaced scanning in accordance with one embodiment of the invention.

FIG. 8B is a schematic diagram of an alternative flicker filtering algorithm for an image displayed through interlaced scanning in accordance with one embodiment of the invention. Here, the flicker filtering technique generates lines from the even field and the odd field that contain the same amount of information. In particular, both the even field and the odd field begin with line zero of the frame and average each pair of lines. For example, line zero and line 1 are averaged to define a first line of the even and the odd fields. Likewise, line 2 and line 3 are averaged to define the second line of the even and the odd fields, and so on. Thus, the first display lines in both the even field and the odd field will now contain the same amount of information. By having the filtered even lines identical to the filtered odd lines, flicker-free images to be displayed in an interlaced fashion are generated for a display screen.

Figure 8C:
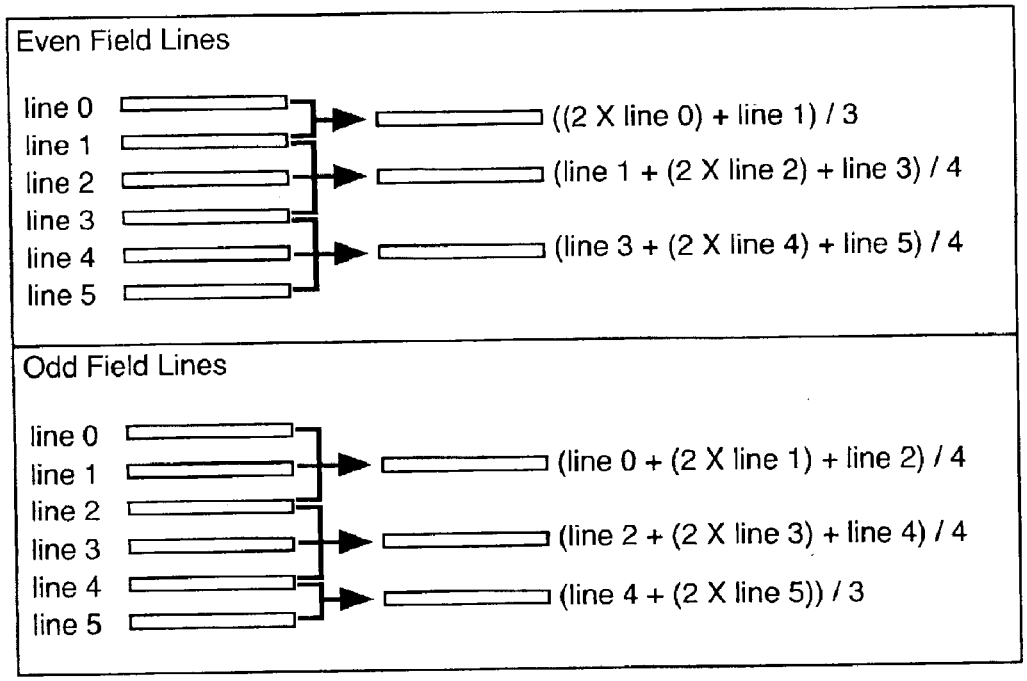
FIG. 8C is a schematic diagram of an alternative mode of flicker filtering even and odd field lines for a computer generated image to be presented in an interlaced fashion in accordance with one embodiment of the invention.

FIG. 8C is a schematic diagram of another alternative mode of flicker filtering even and odd field lines for a computer generated image to be presented in an interlaced fashion in accordance with one embodiment of the invention. Here, a weighted average of multiple lines is used to generate even and odd lines. For example, the first even field line is a weighted average of line zero and line 1. That is, the data of line zero is doubled and added to the data of line 1, whose sum is divided by 3 to obtain a first even field line. As can be seen, the second even field line is calculated by taking a weighted average between lines 1, 2, and 3 where line 2 is counted twice. The odd field lines are similarly calculated, however, for the first odd field line, a weighted average is taken of the first three lines, and so on. The resulting interlaced image presented of the combined filtered even field lines and odd field lines results in a smoother presentation where sharp transitions and contrasts are softened through the weighted average between multiple lines. It should be appreciated that the invention is not limited to the flicker filtering algorithms described with reference to FIGS. 8A–8C as there are many different flicker filter algorithms. Each different flicker filter algorithm may average the pixel data differently, however, a single memory access is used to supply the data to the flicker filter, which in turn is enabled by the storage of data in memory as alternate even and odd segments.

Figure 9:
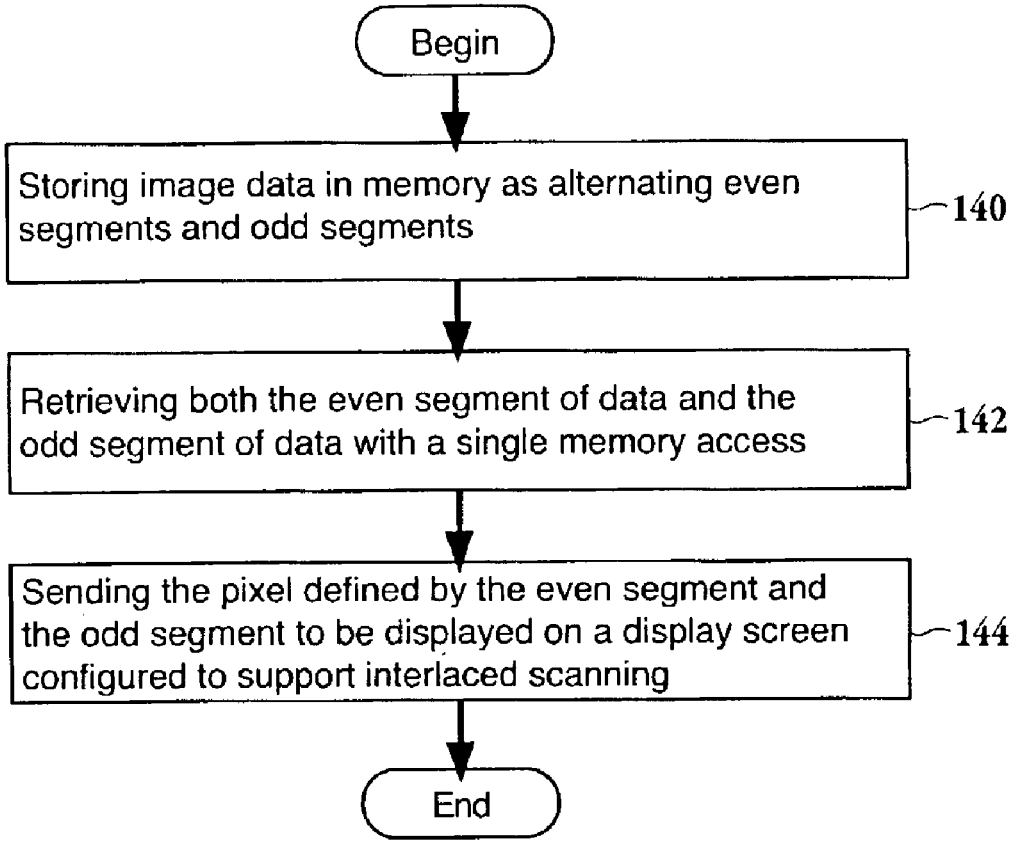
FIG. 9 is a flowchart diagram of the method operations performed for presenting image data to a display screen configured to support interlaced scanning in accordance with one embodiment of the invention.

FIG. 9 is a flowchart diagram of the method operations performed for presenting image data to a display screen configured to support interlaced scanning in accordance with one embodiment of the invention. The method initiates with operation 140 where image data in memory is stored as alternating even segments and odd segments. Here, each pair of an even segment and an odd segment define a pixel. For example, if the even segment and the odd segment are both 16 bit segments, the even segment and odd segment pair define a 32 bit pixel as discussed with reference to FIGS. 4 and 5. In one embodiment, data arrangement circuitry enables the storage of the alternating even and odd segment pairs in memory of a graphics controller. A suitable graphics controller for executing the method operations of FIG. 9 is discussed with reference to FIGS. 2 and 3. The method then advances to operation 142 where both the even segment of data and the odd segment of data are retrieved with a single memory access. That is, one fetch from a display pipe, or display pipes, with reference to FIGS. 7A and 7B, acquires the pair of even and odd segment data. It should be appreciated that the even segment data and the odd segment data correspond to an even and an odd line, respectively, where the even and the odd line are adjacent to each other. More particularly, the even segment and the odd segment correspond to image data that is likewise adjacent to each other in order to filter the data to minimize or substantially eliminate a flicker.

Still referring to FIG. 9, the method then proceeds to operation 144 where a pixel defined by the even and the odd segment pair retrieved from the single memory access is sent to be displayed on a display screen configured to support interlaced scanning, such as a television screen. In one embodiment, the even and odd segment pair are flicker filtered prior to being sent for display. Additionally, the flicker filtering scheme can include an average from corresponding segments of multiple lines of a frame as discussed with reference to FIGS. 8A–8C. Likewise, a pixel can be defined by data from more than two adjacent lines. For example, segments from three consecutive lines can be used to define a pixel, as mentioned above. It should be appreciated that FIGS. 2–4A and 5 are logical representations of the alternating pairs or triplets of image data stored in memory.

In summary, the above embodiments allow for a single memory access to fetch an even and odd segment defining a pixel of data to be displayed as an interlaced scan. By storing segments in an alternating fashion, a single memory access can capture the data so that both an even segment and an odd segment can be supplied to a flicker filter to be averaged.

The above described invention may be practiced with any display system using interlaced scanning to present an image on a display screen. With the above embodiments in mind, it should be understood that the invention may employ various computer-implemented operations involving data stored in computer systems. These operations are those requiring physical manipulation of physical quantities. Usually, though not necessarily, these quantities take the form of electrical or magnetic signals capable of being stored, transferred, combined, compared, and otherwise manipulated. Further, the manipulations performed are often referred to in terms, such as producing, identifying, determining, or comparing.

The invention can also be embodied as computer readable code on a computer readable medium. The computer readable medium is any data storage device that can store data which can be thereafter read by a computer system. Examples of the computer readable medium include hard drives, network attached storage (NAS), read-only memory, random-access memory, CD-ROMs, CD-Rs, CD-RWs, magnetic tapes, and other optical and non-optical data storage devices. The computer readable medium can also be distributed over a network coupled computer systems so that the computer readable code is stored and executed in a distributed fashion.

Although the foregoing invention has been described in some detail for purposes of clarity of understanding, it will be apparent from the foregoing description that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A graphics controller for preparing data to be presented on a display through an interlaced scan, the graphics controller comprising:

a memory;

a line buffer configured to receive video data;

data arrangement circuitry in communication with the line buffer, the data arrangement circuitry configured to process the received video data to enable storage of the received data in the memory as an even segment and a corresponding odd segment, the even segment associated with data from a line of an even field, the odd segment associated with data from a line of an odd field, the even segment and the corresponding odd segment defining at least one pixel of data, the data arrangement circuitry being further configured to determine if writes to the memory are permitted; and a single pipe buffer configured to retrieve the even segment and the corresponding odd segment in a single memory access to the memory.

2. The graphics controller of claim 1, wherein the data arrangement circuitry includes a line buffer counter and a line counter, the line buffer counter configured to monitor receipt of an entire line of data by the line buffer, the line counter configured to count lines of a frame.

3. The graphics controller of claim 2, wherein the line counter outputs a signal to a line counter comparator to determine if writes to memory are permitted.

4. The graphics controller of claim 2, wherein the line buffer counter outputs a signal to a line buffer counter comparator, the line buffer counter comparator is configured to output a signal to both reset the line buffer counter and increment the line counter, upon receipt of the entire line.

5. The graphics controller of claim 1, wherein the data arrangement circuitry prevents writes to memory as the line buffer is being filled with a first line of a frame.

6. The graphics controller of claim 1, wherein the line buffer is a shift register having a plurality of storage circuits.

7. The graphics controller of claim 6, wherein the plurality of storage circuits are clocked latches.

8. The graphics controller of claim 7, wherein a number of clocked latches included in the line buffer is sufficient to store a line of interlaced video data.

9. The graphics controller of claim 1 further including:

a flicker filter, the flicker filter configured to receive output from the single pipe buffer.

10. An apparatus for enabling display of an interlaced image on a display screen, the apparatus comprising:

a central processing unit (CPU);

a bus; and a graphics controller configured to receive image data, the graphics controller in communication with the CPU through the bus, the graphics controller including:

a memory;

data arrangement circuitry for processing image data so that the image data can be stored in the memory as an even segment and a corresponding odd segment, the even segment and the corresponding odd segment defining at least one pixel of data, the data arrangement circuitry being configured to prevent writes to the memory as a line buffer is being filled with a first line of a frame; and a single pipe buffer configured to retrieve the even segment and the corresponding odd segment in a single memory access to the memory.

11. The apparatus of claim 10, wherein the data arrangement circuitry further includes:

a line buffer counter in communication with a first comparator; and a line counter in communication with a second comparator.

12. The apparatus of claim 11, wherein the first comparator is configured to provide both a reset signal to the line buffer counter and an increment signal to the line counter.

13. The apparatus of claim 11, wherein the second comparator is configured to provide a signal to an AND gate, the signal to the AND gate determining whether to allow writes to the memory.

14. The apparatus of claim 10, wherein the graphics controller further includes:

a line buffer.

15. The apparatus of claim 14, wherein the line buffer is a shift register.

16. The apparatus of claim 14, wherein the line buffer includes a plurality of flip flop circuits, the plurality of flip flop circuits sufficient to store one line of interlaced video data.

17. The apparatus of claim 10, wherein the graphics controller further includes;

a flicker filter, the flicker filter configured to average the even segment and the corresponding odd segment to reduce flicker.

18. A method for presenting image data to a display screen configured to support interlaced scanning, the method comprising:

storing image data in memory as alternating even segments and odd segments, each pair of the alternating even segments and odd segments defining a pixel, the storing of image data in memory being delayed until a line buffer in communication with the memory has received one line of data;

retrieving both the even segment of data and the odd segment of data with a single memory access; and sending the pixel defined by the even segment and the odd segment to be displayed on a display screen configured to support interlaced scanning.

19. The method of claim 18, wherein the display screen is a television screen.

20. The method of claim 18, wherein the method operation of storing image data in memory as alternating even segments and odd segments, further includes:

tracking a number of lines of image data received by the line buffer.

21. The method of claim 18 further including:

reducing a flicker of the pixel defined by the even segment and the odd segment.

22. The method of claim 21, wherein the method operation of reducing a flicker of the pixel defined by the even segment and the odd segment further includes:

averaging adjacent even and odd segments of the image data.

23. The method of claim 18, wherein the display screen is a television.

24. A method for storing interlaced image data from an even field and an odd field of a frame, the method comprising;

receiving image data from a video source; and storing the image data in memory as pairs of even and odd segments, the even segments corresponding to an even line, the odd segments corresponding to an odd line, the even line and the odd line being adjacent to each other, wherein the associated even and odd segments define a pixel, the storing being initiated in response to a complete line of the frame being received by a line buffer.

25. The method of claim 24, further including:

counting each line of a frame of the image data received;

determining when a first line of the frame is being received;

accessing the memory to fetch at least one pixel of data in a single memory access; and providing the at least one pixel of data to a flicker filter.

26. The method of claim 25, wherein the flicker filter is configured to average adjacent even and odd segments of the image data.

27. The method of claim 25, wherein the method operation of determining when a first line of the frame is being received further includes:

in response to the first line of the frame being received, delaying writing to memory until a second line of the frame is being received.

* * * * *